US006126390A

United States Patent [19]

Böck

[11] Patent Number: 6,126,390

[45] Date of Patent: Oct. 3, 2000

[54] PASSIVE CLEARANCE CONTROL SYSTEM FOR A GAS TURBINE

[75] Inventor: Alexander Böck, Zossen, Germany

[73] Assignee: Rolls-Royce Deutschland GmbH, Oberursel, Germany

[21] Appl. No.: 09/197,668

[22] Filed: Nov. 23, 1998

[30] Foreign Application Priority Data

Dec. 19, 1997 [DE] Germany ..... 197 56 734

[51] Int. Cl.[7] ..... F01D 5/14; F03B 11/00

[52] U.S. Cl. ..... 415/115; 415/178; 415/116; 415/176

[58] Field of Search ..... 415/115, 116, 415/175, 176, 177, 178

[56] References Cited

U.S. PATENT DOCUMENTS

| | | | |
|---|---|---|---|
| 3,814,313 | 6/1974 | Beam, Jr. et al. | 415/115 X |
| 3,966,354 | 6/1976 | Patterson | 415/116 |
| 3,975,901 | 8/1976 | Hallinger et al. | 415/115 X |
| 4,109,864 | 8/1978 | Clayton | 60/265 X |
| 4,117,669 | 10/1978 | Heller | 415/115 X |
| 4,213,738 | 7/1980 | Williams | 415/115 X |
| 4,217,755 | 8/1980 | Williams | 415/175 X |
| 4,230,436 | 10/1980 | Davison | 415/175 X |
| 4,251,185 | 2/1981 | Karstensen | 415/175 X |
| 4,257,222 | 3/1981 | Schwarz | 415/175 X |
| 4,296,599 | 10/1981 | Adamson | 415/115 X |
| 4,487,016 | 12/1984 | Schwarz et al. | 415/116 X |
| 4,513,567 | 4/1985 | Deveau et al. | 415/178 X |
| 4,565,492 | 1/1986 | Bart et al. | 415/175 |
| 4,613,280 | 9/1986 | Tate . | |
| 4,668,163 | 5/1987 | Kervistin | 415/116 |
| 4,804,310 | 2/1989 | Fuller et al. | 415/15 |
| 4,805,398 | 2/1989 | Jourdain et al. | 415/116 X |
| 4,815,272 | 3/1989 | Laurello | 415/115 X |
| 4,893,983 | 1/1990 | McGreenhan | 415/116 X |
| 4,893,984 | 1/1990 | Davison et al. | 415/116 X |
| 5,048,288 | 9/1991 | Bessette et al. | 415/116 X |
| 5,054,996 | 10/1991 | Carreno | 415/115 |
| 5,064,343 | 11/1991 | Mills | 415/115 X |
| 5,080,557 | 1/1992 | Berger | 415/115 X |
| 5,098,257 | 3/1992 | Hultgren et al. | 415/115 |
| 5,310,319 | 5/1994 | Grant et al. | 416/220 R |
| 5,316,437 | 5/1994 | Czachor | 415/115 |
| 5,358,374 | 10/1994 | Correia et al. | 415/115 X |
| 5,494,402 | 2/1996 | Glezer et al. | 415/115 |
| 5,575,616 | 11/1996 | Hagle et al. | 415/115 |
| 5,584,652 | 12/1996 | Shaffer et al. | 415/115 |
| 5,779,436 | 7/1998 | Glezer et al. | 415/115 |

FOREIGN PATENT DOCUMENTS

| | | |
|---|---|---|
| 2532415 | 2/1982 | Germany . |
| 3040594 | 2/1994 | Germany . |
| 3407218 | 12/1994 | Germany . |

*Primary Examiner*—John E. Ryznic
*Attorney, Agent, or Firm*—Evenson, McKeown, Edwards & Lenahan, P.L.L.C.

[57] ABSTRACT

A passive clearance control system is provided in the turbine section of a gas turbine engine in which turbine casing nozzle vanes and rotor blades are provided. The rotor blades are arranged on a rotor and preferably fitted with a shroud. The tips of the blades or shroud are surrounded by shroud segments suspended in the turbine casing, and a clearance between the tips and the shroud segments is formed and has a width which is controlled by a heating-cooling channel system. The channel system is supplied with a stream of air from the compressor section of the gas turbine and bypasses the combustion chamber to reach, via a plurality of metering holes, an annulus bounded by a stator ring. In a preferred aspect of the present invention, a ring-shaped orifice plate interacting with the metering holes is provided within the annulus which closes these metering holes to a varying degree depending on the temperature of the air stream reaching the heating-cooling channel system. A fraction of the hot gas flowing across the nozzle vanes and rotor blades is allowed to reach the annulus via a clearance between the stator ring and the stator shroud segments at least at a low turbine load.

25 Claims, 3 Drawing Sheets

PASSIVE CLEARANCE CONTROL SYSTEM FOR A GAS TURBINE

This application claims the priority of German patent application No. 197 56 734.7, filed Dec. 19, 1997, the disclosure of which is expressly incorporated by reference herein.

BACKGROUND AND SUMMARY OF THE INVENTION

This invention relates to a passive clearance control system in a high-pressure turbine of a gas turbine engine having a turbine casing in which, in addition to nozzle vanes, blades are provided which are arranged on a rotor and preferably have a shroud. The tips of the rotor blades or the shroud are surrounded by stator shroud segments suspended in the turbine casing, and a clearance is formed between the tips and stator shroud segments with a width which is controlled by a heating-cooling channel system, the channel system being supplied with a stream of air from the compressor section of the gas turbine and passing the combustion chamber of the gas turbine to reach, via a plurality of metering holes, an annulus bounded by a stator ring. For background art, reference is made to DE 30 40 594 C2. A clearance control system commonly includes a turbine casing in which, in addition to nozzle vanes, rotor blades are provided, with the rotor blades being arranged on a rotor and having a shroud surrounded by stator shroud segments. The stator shroud segments are suspended in the turbine casing and form a clearance with a width which is controlled by a heating-cooling channel system.

Gas turbines find widest use in aircraft gas turbine engines. Unlike in stationary applications, these engines are subjected to frequent load alternations and varying environmental constraints, causing dissimilar thermal expansions of the turbine casing on the one hand and of the turbine rotor on the other. The size of the clearance between the turbine blade tips and the surrounding turbine casing varies accordingly. For maximum gas turbine efficiency, it is desired to minimize the clearance size. In larger or more sophisticated gas turbine engines, active clearance control systems are used for this purpose, while in smaller engines, passive clearance control systems, like the simple one disclosed in DE 30 40 594 C2 cited above, may be sufficient.

In passive clearance control systems, especially in gas turbine engines with shrouded rotor blades, the turbine rotor clearance described above is determined, in cruise flight, by what is referred to as a hot reslam characteristic. As an engineer skilled in the art recognizes, the term "hot reslam" denotes hot re-acceleration of the gas turbine engine as briefly outlined below. It is assumed that, after a long cruise flight, both the turbine casing and the rotor section, i.e. the turbine rotor disk(s) bearing the rotor blades, are thoroughly heated to an elevated temperature level. When the engine reverts to low-load operation, e.g. idle speed, the turbine casing with its relatively thin wall section will cool faster than the rotor disks with their comparatively massive shapes. At some time in this process, therefore, the rotor disks will still be hot and expanded by their high temperature, while the turbine casing has already cooled and shrunk back. If, at this time, a high-load operation, such as a maximum operation at take-off, is resumed, then centrifugal force will cause the individual turbine rotor disk(s) to expand even further toward the turbine casing and the tips to come into undesirable contact with the casing.

The hot reslam characteristic worsens as the turbine casing cools more in idle operation and shrinks relative to the rotor. The faster cooling of the turbine casing as compared with the rotor causes the shroud on the rotor blades to grind a groove into the surrounding stator shroud segments of the turbine casing when the hot reslam occurs as described. The unwelcome turbine rotor clearance becomes larger as grinding becomes more intensive in cruise flight.

In a hot reslam condition, during a low-load operation of the aircraft gas turbine engine, the turbine casing should be heated rather than cooled to prevent excessive shrinking of the casing. This would keep the rotor blade shroud from grinding into the stator shroud segments as described above. The object underlying the present invention is to improve a passive clearance control system such that, especially during an idle operation, the turbine casing is heated rather than cooled.

This object is achieved by providing a ring-shaped orifice plate interacting with metering holes and closing the holes to varying degrees depending on the temperature of the incoming air flow to the holes. As a result, a fraction of the hot gases flowing across the nozzle vanes and rotor blades is allowed, at least at a low turbine load, to reach the annulus and preferably its aft or downstream region via a gap between the stator ring and the shroud segments. Further advantageous embodiments and developments are also contemplated.

This invention accordingly provides measures for affecting the temperature of the air flow passing into the heating-cooling channel system. This air flow is actually derived from differing sources. When the metering holes are exposed by the orifice plate, compressor air bypassing the combustion chamber of the gas turbine is allowed to reach the heating-cooling channel system and cool the turbine casing in the usual manner. The compressor air is relatively cool as compared with the hot gas stream of the gas turbine. If the metering holes are closed by the ring-shaped orifice plate, however, then a fraction of the hot gas stream reaches the heating-cooling channel system, causing the turbine casing to be cooled less or even to be heated. This ensures, especially in the hot reslam case in low-load operation, that the clearance between the tips of the rotor blades or of their shroud and the stator shroud segments is large enough to provide ample space to accommodate further expansion of the turbine rotor disk under centrifugal force, or the approach of the rotor blade tips toward the turbine casing when the engine is subsequently pushed into high-load operation, so that the undesirable grinding of the tips into the stator shroud is prevented.

The situation just described, in which a fraction of the hot gas stream reaches the heating-cooling channel system, occurs particularly at the idling point or some other low-load operating point of the gas turbine. Another operating situation, when compressor air bypassing the gas turbine combustion chamber is routed or ducted to the heating-cooling channel system, is, by contrast, a high-load operating range of the gas turbine. This high-load operating range occurs, for example, during cruise flight or take-off of the aircraft powered by the gas turbine engine.

Mixed states between these two extreme states, of course, can occur as well when a small amount of relatively cold air bypassing the gas turbine combustion chamber and a tiny fraction of the hot gas stream both reach the heating-cooling channel system or the annulus. Depending on the detailed design of a clearance control system according to the present invention, therefore, any desired heated or cooled state of the turbine casing can be achieved in order to obtain the desired clearance size between the rotor blade tips and the stator shroud segments surrounding them.

This clearance control system is advantageously passive in nature so that the ring-shaped orifice plate moves to expose or close the metering holes automatically in response to prevailing constraints, i.e. in response to the temperature of the compressor air flow bypassing the combustion chamber. To enable the orifice plate to serve this function, it could be made bimetallic, although a clearance control system in accordance with the invention will be especially simple and reliable when the orifice plate is made of material having a higher coefficient of thermal expansion than the stator ring. The metering holes will then be either closed or exposed simply by the different thermal expansions of the stator ring on the one hand and of the orifice plate on the other. With such an arrangement, best results are achieved when the ring-shaped orifice plate is arranged inside the annulus and has a relatively large circumference and, hence, a relatively large length by which to expand under heat, considering that it extends across the entire diameter of the (aircraft) gas turbine engine.

BRIEF DESCRIPTION OF THE DRAWINGS

Further details of the present invention will become apparent from two preferred embodiments as shown in the accompanying figures.

DESCRIPTION OF THE PREFERRED EMBODIMENTS

Figure 1:
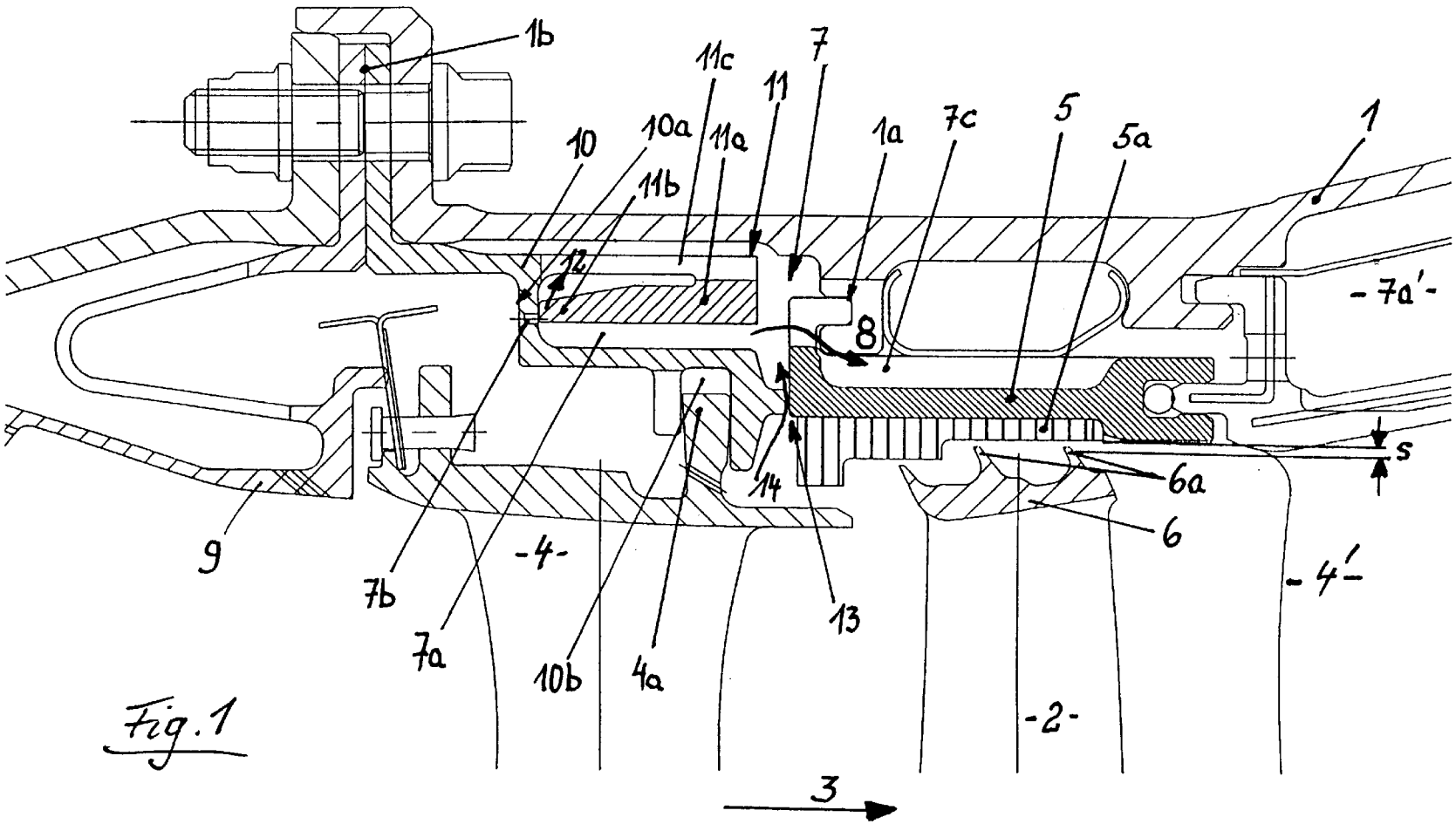
FIGS. 1 and 2 show similar partial sections through clearance control systems according to the invention as used in connection with aircraft gas turbine engines.

In both embodiments, reference number 1 denotes a turbine casing, in which is arranged a rotor bearing a plurality of rotor blades 2. Only one of the blades is shown with parts cut away for clarity of presentation. With reference to the direction of flow 3 of the hot gas stream through this turbine section of the gas turbine, a row of nozzle vanes 4 is arranged upstream of the rotor blade 2 shown, or upstream of the rotor wheel represented by this blade 2, again with only one vane shown with parts cut away. Each nozzle vane 4 is conventionally fixedly connected at its extreme end to the turbine casing 1 by several intervening parts, again omitted from the drawing.

Also conventionally arranged are the stator shroud segments 5 in the circumferential region of the rotor blades 2. These shroud segments 5 conventionally form a closed ring about the longitudinal turbine centerline (omitted), which axially coincides with the direction of flow 3, and have an abradable lining 5*a* on their inner sides facing the rotor blades 2. The various stator shroud segments 5 engage by one or more lugs 5*b* in conforming recesses 1*a* in the turbine casing 1.

In the embodiments illustrated, the rotor blades 2 have a circumferential shroud 6, although this is immaterial to the present invention. A clearance "s" is arranged between the tips 6*a* of the shroud 6, which serve to seal against clearance losses, and the abradable lining 5*a* of the shroud segment 5. In the case of unshrouded rotor blades 2, this gap "s" lies between the tips of the rotor blades 2 and the abradable lining 5*a*, so that the designation "tips 6*a*" is or can be used equally for rotor blades 2 with and without a shroud 6.

Clearance "s" serves an essential natural function, enabling the rotor blades 2 to rotate about the longitudinal turbine centerline (omitted) past the stator shroud segments 5, but should preferably be small to minimize leakage losses. During gas turbine operation, the turbine rotor or the rotor blades 2 may and will undergo different thermal expansions than the turbine casing 1 surrounding these rotor blades 2 and the stator shroud segments 5 engaging in the turbine casing 1. Therefore, the clearance "s" will vary accordingly in size.

To keep the clearance "s" at a minimum at the gas turbine's major operating points or primary operating conditions, a heating-cooling channel system 7 is provided in the turbine casing 1. An air stream 8 from the compressor section of the gas turbine engine is ducted past the combustion chamber and along the walls of the turbine casing 1 by this system to enable heat transfer not only with the casing but also with the rear sides of the shroud segments 5 facing away from the rotor blades 2.

Compared with the hot gas stream flowing in the direction of arrow 3 across the rotor blades 2 and the nozzle vanes 4, which gas is expanded to provide useful turbine power, the air stream 8 is normally substantially colder, so that this colder air stream 8 cools the turbine casing 1 and prevents its excessive thermal expansion as well as a commensurate enlargement of the clearance "s". As previously indicated, this air stream 8 is delivered by the compressor section of the gas turbine and is diverted from it and ducted into the turbine casing 1 at a suitable point. In this embodiment, the partial air stream 8 bypasses the engine or gas turbine combustion chamber alongside its wall. Only the aft section of the outer wall 9 of the combustion chamber is shown.

Forming part of the heating-cooling channel system 7 is an annulus 7*a* which is bounded by a stator ring 10 and extends in the area of nozzle vanes 4 between this stator ring 10 and the turbine casing 1. In this annulus 7*a*, the air stream 8 laterally approaching the combustion chamber outer wall 9 is allowed to enter through metering holes 7*b* provided frontally in the stator ring 10. The air stream 8 can exit this annulus 7*a* via unidentified gaps between the shroud segments 5, or between their lugs 5*b* to reach—as previously described—the rear side of these shroud segments 5, or a cavity 7*c* in that area, and can proceed from there along unidentified routes to, for example, a similar annulus 7*a*' provided between the nearest nozzle vane 4' in the axial direction 3 and the turbine casing 1.

Especially in the case of the hot reslam described above, the clearance "s" between the abradable lining 5*a* and the tips 6*a* may diminish to a point where the tips 6*a* grind into the abradable lining 5*a*. To prevent this undesirable situation, a ring-shaped orifice plate assembly 11 interacting with the metering holes 7*b* is provided in the annulus 7*a* to close the metering holes 7*b* to a degree varying with the temperature of the air stream 8 approaching the metering holes 7*b*.

This orifice plate 11 has a solid ring section 11*a* forming a continuous ring about the longitudinal centerline (omitted) of the turbine, the central axis of which ring is the longitudinal centerline of the turbine. Projecting from this solid ring section 11*a* in annular arrangement is a plurality of orifice sections 11*b* which extend counter to the direction of flow 3, as shown, or in an axial direction, as far as the metering holes 7*b*, or nearly up against the inner side of the face wall 10*a* of the stator ring 10. The face wall 10*a* incorporates the metering holes 7*b*. By means of several arms 11*c*, the ring-shaped orifice plate 11 rests on the stator ring 10, which is suitably connected to the turbine casing 1. The two embodiments of FIG. 1 and FIG. 2 differ regarding the manner of this support for the orifice plate 11 and the configuration of the stator ring 10, which will be discussed in greater detail further below.

At present, however, the operation of the ring-shaped orifice plate 11 is commonly explained for both embodiments. The orifice plate 11 consists of a material having a greater coefficient of thermal expansion than the stator ring 10 carrying it.

Figure 2:
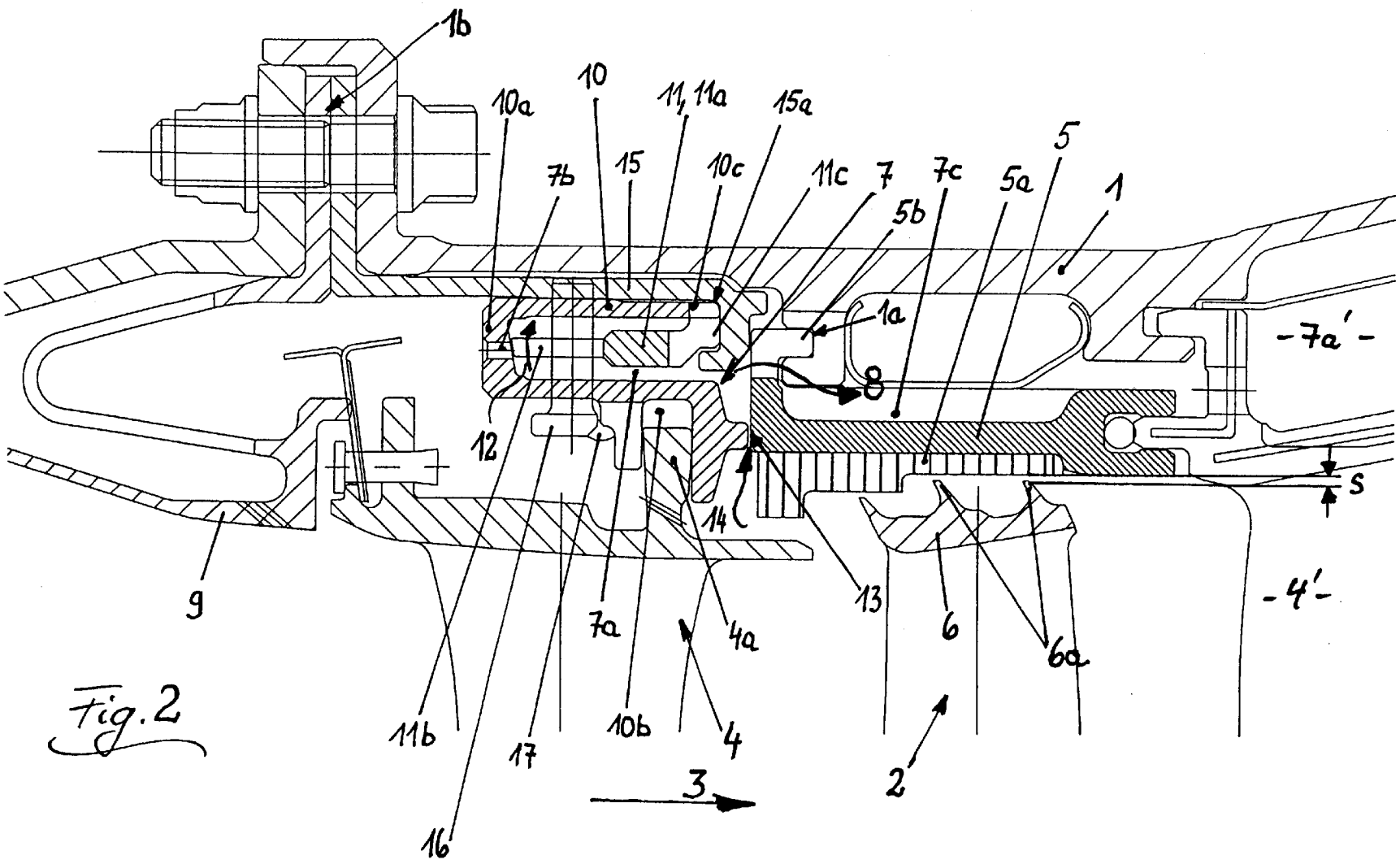

The arrangement of the ring-shaped orifice plate 11, or of its orifice sections 11*b* relative to the metering holes 7*b*, is such that at a relatively low temperature of the air stream 8, as would prevail, for example, in the idling condition of the aircraft engine, the orifice sections 11*b* will cover the metering holes 7*b* and so partially or substantially fully seal them, as shown in FIGS. 1 and 2.

If the air stream 8 has a relatively high temperature, however, then the orifice sections 11*b* move—owing to the different thermal expansions of the stator ring 10 on the one hand and of the ring-shaped orifice plate 11 on the other—in the direction of arrow 12 relative to the stator ring 10, exposing the metering holes 7*b*. The open metering holes 7*b* now allow the air stream 8 to enter the annulus 7*a* via the metering holes 7*b*, and the normal operating condition is restored so that the air stream 8 coming from the compressor section of the gas turbine, bypassing the engine or gas turbine combustion chamber along its outer side, enters the heating-cooling channel system 7.

At this time, the air stream 8 is, as previously indicated, relatively hot as a result of compression in the compressor section of the gas turbine; in this usual, normal operating condition the gas turbine is operated at high or full load, meaning that it is in a cruise flight or even a take-off condition.

If, however, the gas turbine is operated at a low load or at idle, then the temperature of the air stream 8 is considerably lower. Owing to the different thermal expansions of the stator ring 10 on the one hand and of the orifice plate 11 on the other, the orifice sections 11*b* return, counter to the direction of arrow 12, to the position shown in FIGS. 1 and 2, where they substantially cover the metering holes 7*b*.

Accordingly, the measurable air flow 8 through the metering holes 7*b* and into the annulus 7*a* practically ceases. This changes the pressure conditions in the heating-cooling channel system 7, and particularly in the annulus 7*a*, such that a fraction of the hot gas passing in the direction of arrow 3 across the nozzle vanes 4 and the rotor blades 2 can reach, via a clearance 13 between the stator ring 10 and the shroud segments 5, the annulus 7*a*. The route taken by the air in this process is indicated by the arrow 14.

This hot gas or air flow in the direction indicated by arrow 14 merely enters the aft area of the annulus 7*a* and, as a result, hardly affects the ring-shaped orifice plate 11 or its orifice sections 11*b*. The hot gas otherwise would cause the orifice plate 11 to expand to a greater extent than the stator ring 10 and so re-expose the metering holes 7*b*. The hot gas or air reaches past the lugs 5*b* of the shroud segments 5, the annulus 7*c*, or the rear side of the shroud segments 5. Contact with this air flow 14, which is appreciably warmer than the air stream 8, now causes the turbine casing 1*a* to be heated or at least not cooled, at least at the idle operating point of the gas turbine, so that a larger clearance "s" results between the abradable lining 5*a* and the tips 6*a*. This helps prevent the phenomenon described at the outset, in which the tips 6*a* grind into the abradable lining 5*a* in the presence of hot reslam, because when a hot reslam condition sets in, the clearance "s" is larger than in its normal state.

When the gas turbine is accelerated from an idle speed or a suitable low-load operating point to a higher load point, the air stream 8 arrives at a distinctly higher temperature. It impinges on the orifice sections 11*b* of the ring-shaped orifice plate 11, which more or less cover the metering holes 7*b*, and heats these sections, so that owing to the resulting accelerated thermal expansion of the orifice 11 relative to the stator ring 10, these metering holes 7*b* are opened at least to some extent or to a greater extent than before. The resulting increased air flow 8 through the metering holes 7*b* keeps heating the ring-shaped orifice plate 11, causing the metering holes 7*b* to be exposed further still until the previously indicated normal operating condition (not illustrated) is reached so that the only air entering the heating-cooling channel system 7 is that of air stream 8.

When the gas turbine has regained its high-load operating position, the nozzle vanes 4 slightly shift position in the direction of arrow 3 under the relatively strong hot gas stream impinging in that direction, so that the clearance 13 between the stator ring 10 and the shroud segments 5 narrows, since, as illustrated, the nozzle vanes 4 rest against the stator ring 10 in the axial direction 3. A free aft section 4*a* of the nozzle vane 4 or of the entire stator wheel projects into a conforming recess 10*b* of the stator ring 10. The fact that in high-load operation the clearance 13 is narrowed also helps prevent the generally undesirable inrush of hot gas from the areas of the rotor blade 2 and nozzle vane 4 to the turbine casing 1*a*. In idle or low-load operation, a great force from the gas flow does not act on the nozzle vanes 4, so that the clearance 13 is slightly widened. A fraction of the hot gas, therefore, can reach the annulus 7*a* in the direction of arrow 14 via this clearance 13 as previously described. This is desirable at this operating point. It should nevertheless also be noted that the variation in size of clearance 13 just described is not indispensable to the inventive concept; indeed, the effect of this variation is to reduce the cooling air losses when the gas turbine is operating at full-load.

In the embodiment of FIG. 1, the stator ring 10 is bolted directly to the turbine casing 1 at a joint 1*b*, and the stator ring 10 is configured such that the annulus 7*a* is bounded by the ring 10 and by the turbine casing 1. In this embodiment, the ring-shaped orifice plate 11 is attached internally to the face wall 10*a* of the stator ring 10 by its arms 11*c*.

In the embodiment according to FIG. 2, a ring carrier 15 is attached in the same joint 1*b* of the turbine casing 1, and the ring carrier carries the stator ring 10. In this arrangement, the stator ring 10 internally abuts the suitably configured ring carrier 15 and is secured to the ring carrier 15 by several pins 16 seated in unspecified holes and spot welded at weld locations 17 to the stator ring 10 to keep the pins from dropping out. These pins 16 engage in unspecified location holes in the ring carrier 15.

In a departure from the embodiment of FIG. 1, the annulus 7*a* of the embodiment of FIG. 2 is essentially completely bounded by the stator ring 10, which for that purpose is given a U-shaped or channel-shaped section on the outside, as shown. More particularly, however, the ring-shaped orifice plate 11 in the embodiment of FIG. 2 is differently designed and supported from that of FIG. 1. The orifice plate 11 here also has a solid ring section 11*a* and the orifice sections 11*b* interacting with the metering holes 7*b*, and one of the pins 16 is able to pass through the annulus 7*a* between two adjacent orifice sections 11*b* of this type. Here, however, the arms 11*c* project counter to the direction of the orifice sections 11*b* of the solid ring section 11*a* and engage with their free ends in suitable recesses 10*c* in the wall of the stator ring 10 which abuts on the ring carrier 15. These recesses 10*c* are arranged on the free end of the wall of the stator ring 10, so that the arms 11*c* are pivotally suspended in these recesses 10*c* by their free ends, resting against the suitably configured ring carrier 15. In this area, the ring carrier 15 is L-shaped to form a radial abutment surface 15*a* for the free ends of the arms 11*c*.

This arrangement allows the orifice sections 11*b* of the orifice plate 11 to move especially effectively relative to the metering holes 7*b* during thermal expansion. This will also become apparent from the following brief description of FIG. 3, which shows enlarged views of the stator ring 10 and of the ring-shaped orifice plate 11 in various positions. The various positions of the orifice sections 11*b* and of the arms 11*c* of the orifice plate 11 are indicated by Roman numerals I to IV positioned at lower edges of the orifice sections 11*b* and at upper edges of the arms 11*c*. Roman numeral I indicates the as-installed position of the ring-shaped orifice plate 11, Roman numeral II indicates the idle position, Roman numeral III indicates the cruise position, and Roman numeral IV indicates the full-load or maximum take-off position.

As is apparent, the arms 11*c* allow the ring-shaped orifice plate 11 free radial movement under thermal expansion, although the plate is torsioned on account of its radial support by the free ends of the arms 11*c*. The radially different thermal expansions and the torsion of the orifice plate 11 cause greater radial movement relative to the metering holes 7*b* at the ends of the orifice sections 11*b* in or counter to the direction of arrow 12, like that of a rocker. In this manner, relatively wide movements in the direction of arrow 12 are achieved even when temperature differences at the metering holes 7*b* are still small. These relatively wide relative movements permit relatively large holes to be used for the metering holes 7*b*, which affords an advantage with respect to compliance with manufacturing and component tolerances.

Figure 3:
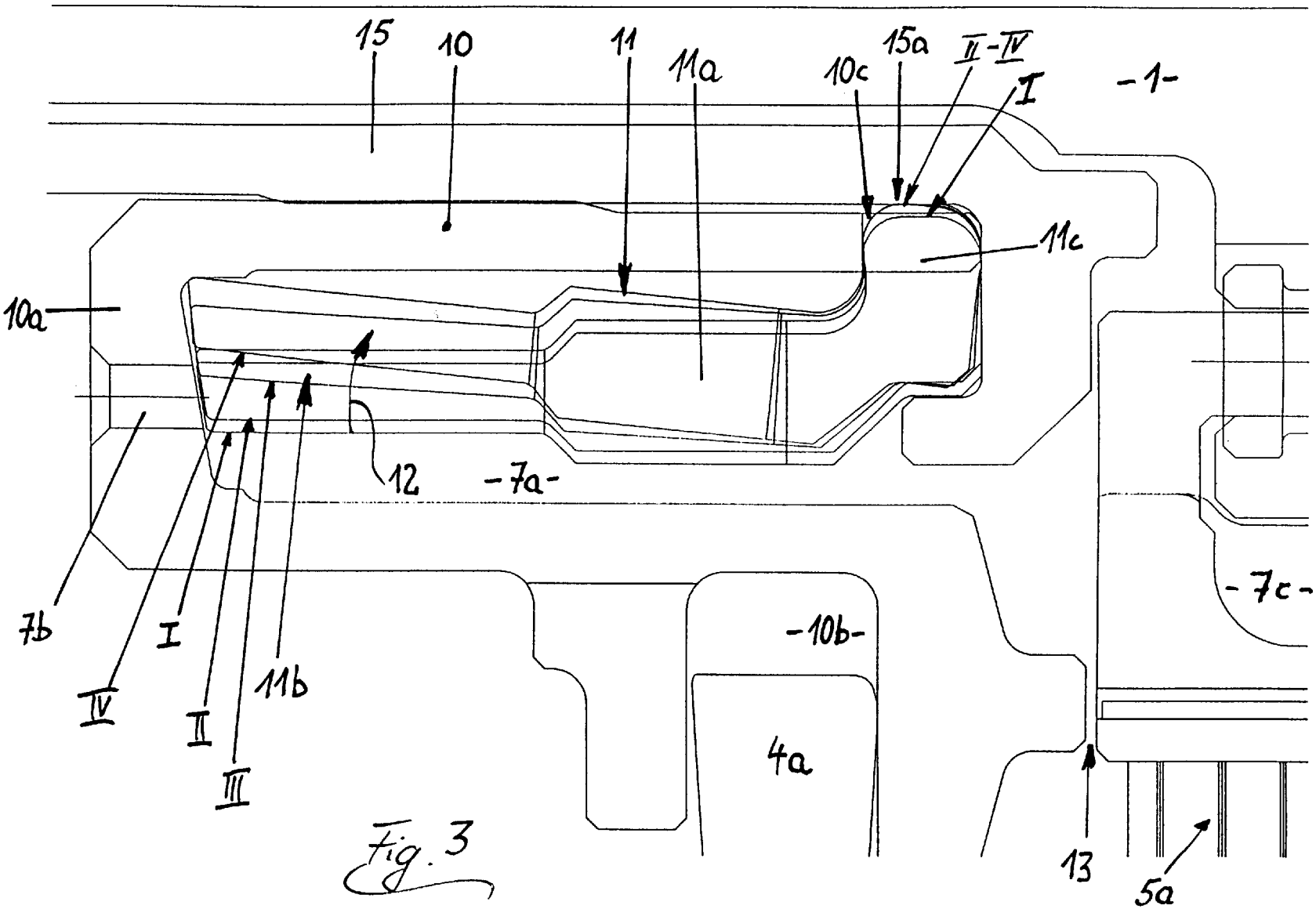
FIG. 3 is an enlarged view of a portion of the system illustrated in FIG. 2.

The embodiment of FIGS. 2 and 3 operates in a mode which is briefly summarized below.

It is assumed that, in an idle condition of the gas turbine, the metering holes 7*b* are sealed by their associated orifice sections 11*b* as illustrated in FIG. 2. When the gas turbine engine is completely cold, as in perhaps its assembly condition, a clearance is formed between the free ends of the arms 11*c* and their radial abutment faces 15*a* on the ring carrier 15, as shown in FIG. 3. This clearance first diminishes when the turbine casing 1, and hence the stator ring 10 and the ring-shaped orifice plate 11, heat up, with the orifice plate having, as previously mentioned, a higher coefficient of thermal expansion than the stator ring 10 and also than the ring carrier 15 and the turbine casing 1. If the gas turbine is operated at a high-load, such as that present during cruising or take-off, the air stream 8 heats up sufficiently to cause the orifice plate 11 to pick up additional heat and, owing to its higher coefficient of thermal expansion, to expand more rapidly than the stator ring 10 or the ring carrier 15. This causes the solid ring section 11*a* of the orifice plate 11 to be torsioned and the metering holes 7*b* to be opened, allowing an air stream 8 from the compressor section of the gas turbine bypassing the combustion chamber to reach the annulus 7*a* and hence the heating-cooling channel system 7, so that the turbine casing 1 is cooled as desired. In this process, the change, as previously described, in clearance 13, via which a fraction of the hot gas can reach the heating-cooling channel system 7, naturally occurs here again, and this clearance 13 becomes much narrower in a high-load operation of the gas turbine than in an idle operation of the turbine. An essential difference between the embodiment shown in FIG. 2 and the embodiment shown in FIG. 1 is that, owing to the torsioning effect, even relatively minor differences in temperature of, for example 200° C., will be sufficient to either expose the metering holes 7*b* or seal them with the orifice sections 11*b*.

In summary, the invention therefore provides a passive clearance control system which ensures that, during high-load operation of the gas turbine, the turbine casing 1 is adequately temperature conditioned, but that in a hot reslam condition as previously described, with full-load operation following low-load or idle operation, the clearance "s" between the tips 6*a* of the rotor blades 2 and the abradable lining 5*a* of the shroud segments 5 will never become zero or negative. A large number of modifications, especially design modifications, other than those described herein may be made to the embodiments of this invention without departing from the inventive concept.

What is claimed is:

1. Passive clearance control system in the turbine section of a gas turbine including a turbine casing in which, in addition to nozzle vanes, rotor blades are provided, said rotor blades being arranged on a rotor and preferably having a shroud, tips of said shroud being surrounded by stator shroud segments suspended in the turbine casing and forming a clearance with a width which is controlled by a heating-cooling channel system, said heating-cooling channel system being supplied with air from an air stream from a compressor section of the gas turbine and bypassing a combustion chamber of the gas turbine, said air stream reaching an annulus, which is bounded by a stator ring, via a plurality of metering holes, said passive clearance control system comprising:

a ring-shaped orifice plate interacting with the metering holes, said orifice plate closing said metering holes to varying degrees as a function of the temperature of the air stream reaching said metering holes, wherein a fraction of hot gas flowing across the nozzle vanes and the rotor blades is allowed to reach an aft portion of the annulus, when viewed in a direction of flow through the gas turbine, via a clearance between the stator ring and the stator shroud segments in a low-load turbine operation.

2. Clearance control system in accordance with claim 1, wherein the ring-shaped orifice plate comprises a material that has a higher coefficient of thermal expansion than that of the stator ring.

3. Clearance control system in accordance with claim 1, wherein the ring-shaped orifice plate is arranged within the annulus and has orifice sections interacting with the metering holes provided in the face of the stator ring, said orifice sections projecting in a substantially axial direction of the gas turbine from a solid ring section of the orifice plate, said solid ring section resting against the stator ring by way of arms.

4. Clearance control system in accordance with claim 3, wherein the arms project from the solid ring section of the orifice plate in a direction away from the orifice sections and engage with their free ends in recesses in the stator ring.

5. Clearance control system in accordance with claim 1, wherein free aft sections of the nozzle vanes abut axially on the stator ring at least during high-load operation.

6. Clearance control system in accordance with claim 1, wherein the stator ring is held in position by several pins on a ring carrier connected to the turbine casing.

7. Clearance control system in accordance with claim 2, wherein the ring-shaped orifice plate is arranged within the annulus and has orifice sections interacting with the metering holes provided in the face of the stator ring, said orifice sections projecting in a substantially axial direction of the gas turbine from a solid ring section of the orifice plate, said solid ring section resting against the stator ring by way of arms.

8. Clearance control system in accordance with claim 7, wherein the arms project from the solid ring section of the orifice plate in a direction away from the orifice sections and engage with their free ends in recesses in the stator ring.

9. Clearance control system in accordance with claim 2, wherein free aft sections of the nozzle vanes abut axially on the stator ring at least during high-load operation.

10. Clearance control system in accordance with claim 3, wherein free aft sections of the nozzle vanes abut axially on the stator ring at least during high-load operation.

11. Clearance control system in accordance with claim 4, wherein free aft sections of the nozzle vanes abut axially on the stator ring at least during high-load operation.

12. Clearance control system in accordance with claim 7, wherein free aft sections of the nozzle vanes abut axially on the stator ring at least during high-load operation.

13. Clearance control system in accordance with claim 8, wherein free aft sections of the nozzle vanes abut axially on the stator ring at least during high-load operation.

14. Clearance control system in accordance with claim 2, wherein the stator ring is held in position by several pins on a ring carrier connected to the turbine casing.

15. Clearance control system in accordance with claim 3, wherein the stator ring is held in position by several pins on a ring carrier connected to the turbine casing.

16. Clearance control system in accordance with claim 4, wherein the stator ring is held in position by several pins on a ring carrier connected to the turbine casing.

17. Clearance control system in accordance with claim 5, wherein the stator ring is held in position by several pins on a ring carrier connected to the turbine casing.

18. Clearance control system in accordance with claim 7, wherein the stator ring is held in position by several pins on a ring carrier connected to the turbine casing.

19. Clearance control system in accordance with claim 8, wherein the stator ring is held in position by several pins on a ring carrier connected to the turbine casing.

20. A passive clearance control system for a turbine section of a gas turbine comprising:

a turbine casing containing nozzle vanes and rotor blades arranged on a rotor and including a shroud, stator shroud segments surrounded by said shroud and suspended in the turbine casing so as to form a first clearance between the shroud and the stator shroud segments, a stator ring including a plurality of metering holes, defining a second clearance together with said stator shroud segments, and defining an annulus into which an air stream flows through said metering holes from a compressor section of the gas turbine, a heating-cooling channel system defined between said turbine casing and said stator ring which controls a width of said first clearance, and a ring-shaped orifice plate closing said metering holes to varying degrees as a function of a temperature of an air stream from a compressor section of the gas turbine reaching said metering holes so that a variable fraction of hot gas flowing across the nozzle vanes and the rotor blades is allowed to reach the annulus via said second clearance.

21. The passive clearance control system in accordance with claim 20, wherein the ring-shaped orifice plate is formed of a material that has a higher coefficient of thermal expansion than that of the stator ring.

22. The passive clearance control system in accordance with claim 20, and further comprising arms defined on the ring-shaped orifice plate, wherein the ring-shaped orifice plate is arranged within the annulus and has orifice sections interacting with the metering holes included in the stator ring, said orifice sections projecting in a substantially axial direction of the gas turbine from a solid ring section defined on the orifice plate, said solid ring section resting against the stator ring by way of said arms.

23. The passive clearance control system in accordance with claim 22, wherein the arms project from a solid ring section of the orifice plate in a direction away from the orifice sections and have free ends which engage in recesses in the stator ring.

24. The passive clearance control system in accordance with claim 20, wherein free aft sections of the nozzle vanes abut axially on the stator ring.

25. The passive clearance control system in accordance with claim 20, wherein the stator ring is held in position by several pins on a ring carrier connected to the turbine casing.

* * * * *